United States Patent [19]

Berry

[11] 3,943,718

[45] Mar. 16, 1976

[54] STEAM GENERATION SYSTEM

[76] Inventor: Clyde F. Berry, R.F.D. No. 1, Box 169-C, Manchester, N.H. 03104

[22] Filed: Mar. 25, 1974

[21] Appl. No.: 454,462

Related U.S. Application Data

[63] Continuation-in-part of Ser. No. 431,204, Jan. 7, 1974, abandoned.

[52] U.S. Cl. ..... 60/676

[51] Int. Cl.[2] ..... F01K 13/00

[58] Field of Search ..... 60/670, 671, 676, 652

[56] References Cited

UNITED STATES PATENTS

| | | | |
|---|---|---|---|
| 2,346,179 | 4/1944 | Meyer et al. | 60/676 |
| 3,216,199 | 11/1965 | Shaw et al. | 60/670 |
| 3,267,678 | 8/1966 | Camp | 60/670 |

FOREIGN PATENTS OR APPLICATIONS

| | | | |
|---|---|---|---|
| 333,102 | 8/1930 | United Kingdom | 60/676 |

*Primary Examiner*—Martin P. Schwadron
*Assistant Examiner*—H. Burks, Sr.
*Attorney, Agent, or Firm*—C. Yardley Chittick

[57] ABSTRACT

Supplementary means for heating liquid in a steam producing boiler comprising an electrical heating unit located in the boiler, the current for which is produced by an electric generator driven by a steam operated turbine. The turbine may utilize all or only part of the steam output of the boiler. Where the turbine uses substantially all of the steam, the generator driven by the turbine will have excess capacity to be used to drive a motor. Where the turbine uses only enough steam to drive a generator sized to meet the needs of the heating unit, the balance of the steam will ordinarily be used to drive some major prime mover or to supply heat to a heating system.

3 Claims, 3 Drawing Figures

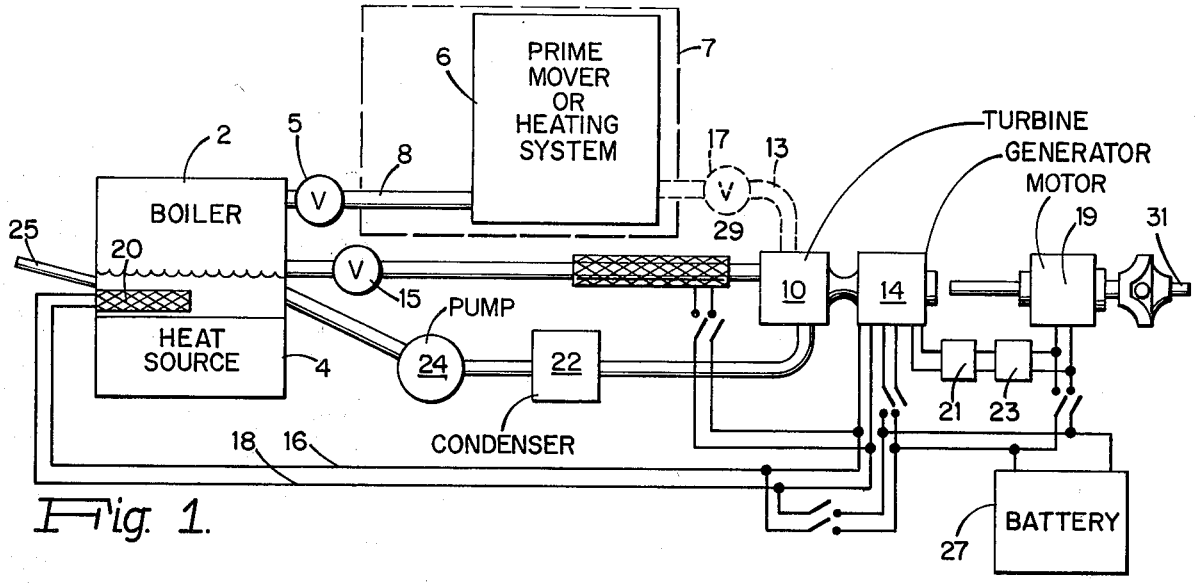
Fig. 1.
Fig. 2.
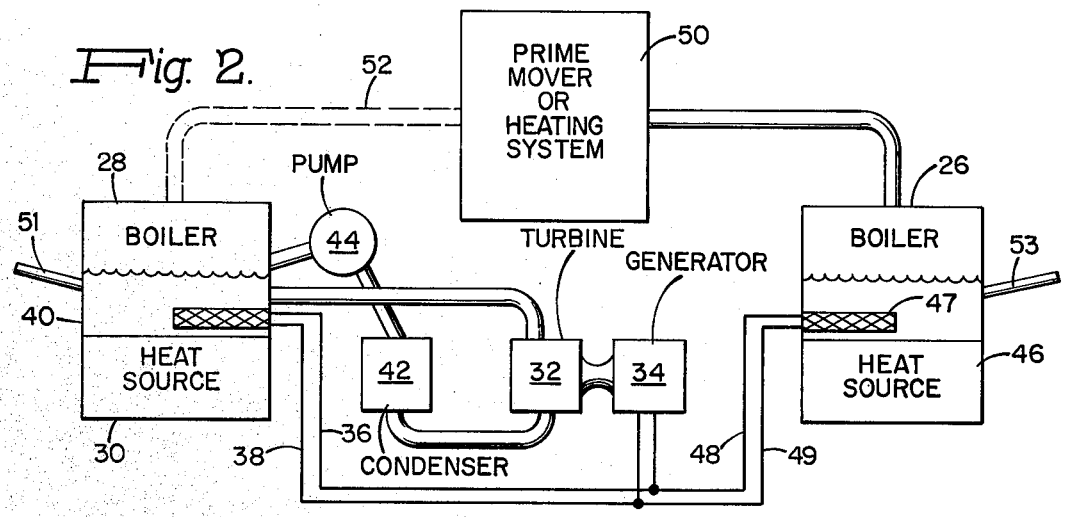
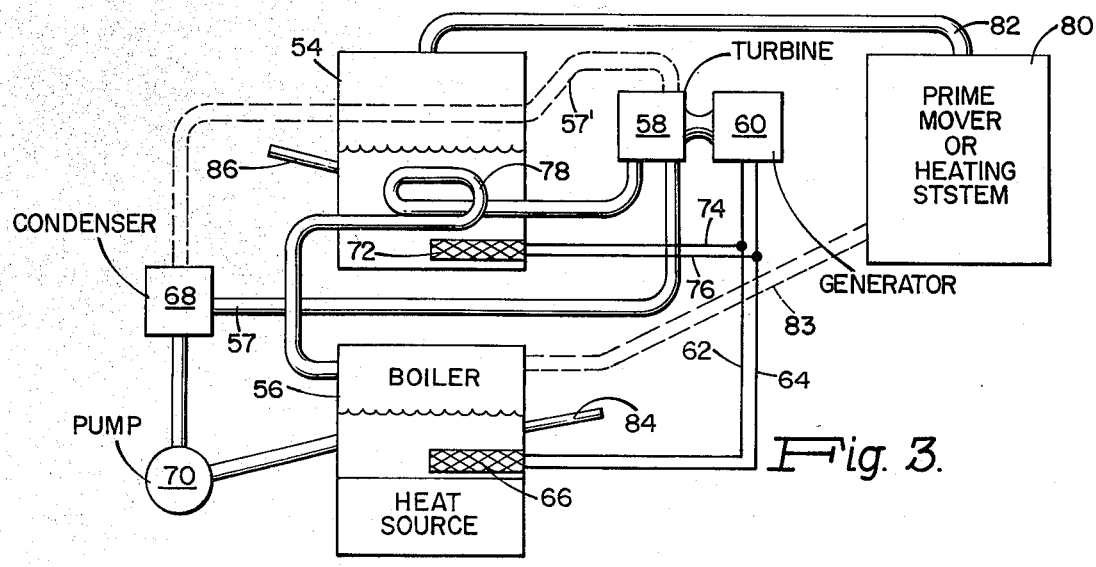
Fig. 3.

STEAM GENERATION SYSTEM

RELATED APPLICATIONS

This application is a continuation-in-part of the application of Clyde F. Berry, Ser. No. 431,204 filed Jan. 7, 1974, and now abandoned.

FIELD OF INVENTION

The invention relates to steam generation and utilization. Steam is ordinarily used as means for heating or for driving some prime mover such as a steam turbine or reciprocating engine.

In the case of steam heating, the system is usually closed and the condensate is returned to the boiler for reuse.

In the case of steam driven engines, the exhaust steam leaving the prime mover may be discharged to the atmosphere or in a closed system delivered to a condenser to be returned as water to the boiler through the use of a suitable pump.

In the production of steam for heating or power or other use, the heat source customarily is coal, oil or gas or other combustible fuel.

SUMMARY OF THE INVENTION

In the present invention, it is proposed to include in the boiler of a steam producing system, an auxiliary source of heat in the form of an electric heating element.

In the preferred arrangement, a single boiler, powered by a conventional heat source using oil, gas, coal or, preferably, a non-polluting fuel such as alcohol, may be used with a minor part of the steam driving a turbine-generator set to produce the current for the electrical heating unit that is permanently installed in the boiler. The major part of the steam may be piped directly from the boiler to actuate a prime mover such as a reciprocating steam engine or turbine or be used as the heat source in a heating system. Alternatively, all of the steam may be utilized to drive a steam engine, preferably a turbine, which drives an electric generator of greater capacity than needed to operate the auxiliary electrical heating unit in the boiler. The surplus electrical capacity of the generator may then be used to drive a variable speed reversible electric motor. The foregoing system of boiler, turbine, generator, auxiliary electric heater and motor could be utilized as the power plant for a self-propelled vehicle such as an automobile, train or boat. Some of the excess generator capacity could also be diverted to charge one or more storage batteries in the vehicle for use when needed as an auxiliary power source.

Preferably the exhaust from the turbine of the turbine-generator set will pass to a condenser from which the condensate will be pumped back into the boiler. The exhaust from the prime mover likewise is preferably condensed and returned to the boiler. The steam in the heating system will also condense and drain back to the boiler.

In another form of the invention, the boiler provides steam used solely to drive the turbine-generator set and a second boiler powered principally by a conventional heat source is utilized to provide the steam for the prime mover or the heating system. The current supplied by the generator is fed not only to the electrical heating unit in the first boiler, but also to a second electrical heating unit located in the second boiler.

In still another form of the invention, the second boiler, instead of being powered principally by a conventional heat source, has its water brought to steam producing temperature through the use therein of a coiled steam pipe carrying high temperature steam generated in the first boiler plus the auxiliary electrical heating element and, if desired, through the use of another pipe passing through the boiler which pipe carries exhaust steam from the turbine en route to the condenser.

The object in all cases is to improve the efficiency of a power producing system and thereby to minimize pollution of the atmosphere.

These and other objects of the invention will become more apparent as the description proceeds with the aid of the accompanying drawings in which FIG. 1 shows a first form of the invention in which a single boiler provides all the steam necessary to operate the turbine-generator set and the prime mover or heating system and alternatively to drive a motor by use of surplus capacity from the generator.

FIG. 2 shows a second form of the invention in which the steam for generating the electric power for the auxiliary heater is produced by a first boiler and the steam for operating the prime mover or the heating system is produced by a second boiler.

FIG. 3 shows a third form of the invention in which the steam for generating the electric power for the auxiliary heater is produced by a first boiler and the steam for operating the prime mover or heating system is produced in a second boiler that is heated solely by the output of the first boiler.

DESCRIPTION OF A PREFERRED EMBODIMENT

Referring first to FIG. 1, there is shown a steam boiler 2 in which the water is heated by any conventional heat source 4 using oil, gas, coal or a non-polluting fuel such as alcohol. Part of the steam controlled by a valve 5 is piped to a prime mover or heating system 6 through pipe 8. Another part of the steam controlled by valve 15 is delivered to a small preferably multi-stage turbine 10 through pipe 12. Turbine 10 drives a generator 14 from which current is delivered by wires 16 and 18 to an electric heater 20 permanently located in boiler 2.

Exhaust from the turbine 10 is fed to a condenser 22 and the condensate is pumped back to the boiler 2 by a centrifugal feed water pump 24 whose motor is driven by utility electric power or by some of the current produced by the generator 14.

The exhaust from prime mover 6 is preferably condensed and returned to boiler 2 (by conventional means not shown) but otherwise it may be exhausted to atmosphere. If the steam is being used to heat a heating system, it will condense and be returned to boiler 2 in conventional manner.

Alternatively, the steam used to drive turbine 10, instead of flowing directly from boiler 2 through pipe 12, may reach turbine 10 as exhaust steam from unit 6 by passage through pipe 13 shown in dotted lines in FIG. 1.

In still another arrangement where it may be desirable to place the system in an automobile or other self-propelled vehicle, valves 5 and 17 are closed thereby to remove completely prime mover or heating system 6 from the combination. The dot dash line 7 indicates this elimination of part 6. Valve 15 is open so that all steam goes directly to turbine 10 which is large enough to utilize the full steam capacity of boiler 2. Generator 14 may now be made much larger than needed merely for the heating of auxiliary heating unit 20. This excess capacity of generator 14 may be used to drive a variable speed reversible electirc motor 19 under the control of conventional devices such as rheostat 21 and reversing switch 23. Motor 19 is shown as connected to a drive shaft 31 which may be that of an automobile of propeller shaft of a boat for example.

Some of the output of generator 14 may be used to charge one or more batteries 27 which may be used as an auxiliary power source if and when needed. Additionally some of the output may be used to heat an electrical heating element 29 mounted on steam pipe 12 to raise the steam temperature and pressure.

A conventional feed water line 25 is provided for boiler 2.

MODIFICATION

In the construction shown in FIG. 2 the steam used in the prime mover or heating system is generated in a second boiler 26 as distinguished from FIG. 1 in which all of the steam was generated in a single boiler 2.

In FIG. 2 the boiler 28 and its heat source 30 are the same as boiler 2 and heat source 4 of FIG. 1. The turbine 32, generator 34, wires 36 and 38, heating element 40, condenser 42 and pump 44 are the same as the corresponding units in FIG. 1.

The heat needed to generate steam in the second boiler 26 is provided by a separate heat source 46 and a separate electric heating element 47 whose current comes from generator 34 through wires 48 and 49. Steam from boiler 26 feeds the prime mover or heating system 50. Alternatively some of the steam generated in boiler 28 could be used to assist in operation of unit 50 by additional piping 52 shown in dotted lines. This assumes that the capacity of boiler 28 is more than adequate to drive the turbine-generator set 32, 34. Conventional feed water lines 51 and 53 are provided for boilers 28 and 26.

SECOND MODIFICATION

The construction shown in FIG. 3 differs from the construction of FIG. 2 in that the second boiler 54 derives its initial heat from the first boiler 56. In FIG. 3, the boiler 56, turbine 58, generator 60, wires 62, 64, heating element 66, condenser 68 and pump 70 are all similar to the corresponding parts in FIGS. 1 and 2.

The water in boiler 54 receives its heat from three sources; (a) electric heater 72 fed through wires 74 and 76; (b) from a steam coil 78, and (c) if desired, changing the position of pipe 57 running to condenser 68 from turbine 58 to a location in which it passes through boiler 54 as indicated at 57'. In this arrangement boiler 56 will be capable of generating steam of sufficiently high temperature to keep coil 78 well above the temperature required to produce steam in boiler 54. The coil 78 and exhaust steam pipe 57 from turbine 58, plus the heating element 72 are adequate to generate all the steam necessary to operate prime mover or heating system 80 to which steam is delivered by pipe 82. Alternatively, some of the steam generated in boiler 56 could be used to assist in the operation unit 80 by additional piping 83 shown in dotted lines. This assumes that the capacity of boiler 56 is more than adequate to drive the turbine-generator set 58, 60. Conventional feed water lines 84 and 86 are provided on boilers 56 and 54.

In all of the above illustrations there is a turbine-generator set operated by steam from a first boiler which set supplies current to an electric heating element permanently located in the first boiler. Where there is a second boiler, the generator supplies current not only to the heating element in the first boiler, but also to a heating element in the second boiler.

Alternative arrangements for using steam beyond the requirements of heating unit 20 are shown in FIG. 1. In one case, part of the steam drives turine 10 and the remainder actuates element 6. In the second case all of the steam goes to the turbine to create excess capacity in generator 14 which excess is used to drive motor 19. It will be understood in FIG. 1 that when element 6 is in use, motor 19 will be omitted from the system and generator 14 need only be of sufficient capacity to heat unit 20. Conversely when motor 19 is in the system, element 6 will be omitted.

The steam pressures in the boilers may vary according to the power requirements of the turbine-generator set, the prime mover and/or the heating system. The steam conditions could range from low pressure saturated steam to high pressure super-heated steam.

In all forms of the invention as disclosed above, it will be noted that the electrical heating element 20, 40 or 66 is permanently positioned within first boiler 2, 28 or 56 respectively and provides a means for assisting the primary source heat in raising temperature of the water to the point of steam generation. The current for the supplementary heater is provided in the first instance through the direct use of steam from the boiler and in the second instance, as shown in FIG. 1, as steam which might otherwise be exhausted to atmosphere.

The turbine 10 may be replaced with any other form of steam engine capable of driving generator 14. When the term turbine is used in the claims, it is illustrative and not limiting.

Generator 14 is preferably a direct current generator and motor 19 a direct current motor whose speed and direction of rotation can be controlled by conventional devices. Motor 19 can be stopped while generator 14 remains in operation thus making the system adaptable for driving an automobile. The voltage and current output of generator 14 match the requirements of motor 19. Alternatively the generator and motor could be of the alternating current type.

The appended claims are intended to cover all forms of the invention falling within the scope of the disclosure.

I claim:

1. In combination, a first boiler in which steam may be generated, a conventional source of heat for said boiler, a turbine, means for delivering steam from said first boiler to said turbine, a generator driven by said turbine, an electrically operated heating element located within said first boiler energized by current from said generator, said heating element adapted to act when heated as a supplementary source of heat to aid in the production of steam in said first boiler, the steam exhausted from said turbine passing through a pipe to a condenser and a pump for returning the condensate to said boiler, a second steam boiler, means for heating the water in said second boiler to generate steam, said heating means for said second boiler comprising a) an electrically operated heating element located within said second boiler and energized by current from said generator, and b) means for delivering steam from said first boiler to said turbine which means comprises a steam carrying pipe that has part thereof positioned in the water of said second boiler, and means for utilizing the steam generated in said second boiler.

2. The combination set forth in claim 1, said first boiler also supplying steam to the said steam utilization means.

3. The combination set forth in claim 1, said pipe carrying exhaust steam from said turbine to said condenser passing through said second boiler.

* * * * *